US007818901B2

(12) United States Patent
Zeno et al.

(10) Patent No.: US 7,818,901 B2
(45) Date of Patent: Oct. 26, 2010

(54) PROGRESSIVE LINKAGE FOR EXCAVATOR THUMB

(75) Inventors: Joseph R. Zeno, Akron, OH (US); Christophor Napier, Tallmadge, OH (US); Robert J. Willoughby, Munroe Falls, OH (US)

(73) Assignee: ACS Industries, Inc., Kent, OH (US)

( * ) Notice: Subject to any disclaimer, the term of this patent is extended or adjusted under 35 U.S.C. 154(b) by 0 days.

(21) Appl. No.: 12/192,807

(22) Filed: Aug. 15, 2008

(65) Prior Publication Data

US 2009/0077840 A1 Mar. 26, 2009

Related U.S. Application Data

(60) Provisional application No. 60/974,447, filed on Sep. 21, 2007.

(51) Int. Cl.
*E02F 3/96* (2006.01)

(52) U.S. Cl. ..... 37/406; 37/410; 37/903; 414/739

(58) Field of Classification Search ..... 37/306, 37/903, 403, 410; 414/724, 729, 739–740
See application file for complete search history.

(56) References Cited

U.S. PATENT DOCUMENTS 2,455,474 A * 12/1948 Drott et al. ..... 414/707
3,243,067 A * 3/1966 Artman ..... 414/704
3,658,202 A * 4/1972 Peterson ..... 414/707
3,872,991 A * 3/1975 Pasideris et al. ..... 414/707
3,972,097 A 8/1976 Schakat
4,029,226 A * 6/1977 Seaberg ..... 414/696
4,199,033 A * 4/1980 Van Gundy, Jr. ..... 173/27
4,283,866 A * 8/1981 Ogawa ..... 37/406
4,344,734 A * 8/1982 Shumaker ..... 414/710
4,375,345 A * 3/1983 Hanson ..... 414/722
4,381,167 A 4/1983 Baty
4,519,739 A * 5/1985 Risch ..... 414/724
4,925,358 A * 5/1990 Cook ..... 414/685
5,553,408 A * 9/1996 Townsend ..... 37/406
5,592,762 A 1/1997 Hendron et al.
5,678,332 A * 10/1997 Hawkins ..... 37/403
5,813,822 A * 9/1998 Pisco ..... 414/723
6,120,237 A * 9/2000 Cummings et al. ..... 414/729
6,260,294 B1 * 7/2001 Pitcher ..... 37/406
6,450,081 B1 9/2002 Sorbel
6,453,586 B1 * 9/2002 Wolin et al. ..... 37/406
6,467,202 B1 * 10/2002 Brown, Jr. ..... 37/445
6,742,291 B2 * 6/2004 Frigon et al. ..... 37/406
7,165,930 B2 * 1/2007 Pisco ..... 414/729

* cited by examiner

*Primary Examiner*—Thomas A Beach
(74) *Attorney, Agent, or Firm*—Zallinger & Burleson Ltd

(57) ABSTRACT

An improved dipper stick, tool, and thumb combination includes a progressive linkage for connecting the thumb to a thumb actuator wherein the pivot axis of the thumb idler link connection is spaced from the pivot axis of the tool idler link connection. The pivot axis of the thumb idler link connection may be offset outwardly from the inner surface of the dipper stick. A mounting plate may be connected to the inner surface of the dipper stick to locate the pivot axis in the offset position.

16 Claims, 12 Drawing Sheets

PROGRESSIVE LINKAGE FOR EXCAVATOR THUMB

CROSS REFERENCE TO RELATED APPLICATIONS

This application claims the benefit of U.S. Provisional Patent Application Ser. No. 60/974,447 filed Sep. 21, 2007; the disclosures of which are incorporated by reference.

BACKGROUND OF THE INVENTION

1. Technical Field

The present invention generally relates to the linkage used to control a thumb used with a bucket on a prime mover such as an excavator. More particularly, the invention relates to a unique mounting and operating configuration for the progressive linkage of the thumb affixed to the dipper stick. Specifically, the present invention relates a thumb progressive linkage that is mounted to a dipper stick independent of the pin and linkage assembly used to control an attachment on the end of the dipper stick.

2. Background Information

An excavator is a machine that generally includes a boom that supports an extendable arm, known in the trade as a "dipper arm," a "dipper stick," or a "stick" onto which is attached an excavator tool—such as an excavator bucket or rake. The excavator tool is typically attached to the distal end of the dipper stick with a pivot pin. A piston cylinder assembly operating through a tool linkage assembly is used to control the excavator tool.

An excavator thumb may be used in combination with any of a variety of excavator tools. Pin on types of excavator thumbs typically connected to the distal end of the dipper stick with a pivot pin that also serves to mount the excavator tool. The pin on excavator thumb may be mounted in three control configurations including a stiff arm configuration, a direct connect configuration, and a progressive linkage configuration. The progressive linkage configuration provides a wider range of motion to the thumb than the other control configurations. The progressive linkage control configuration also locates the end of the cylinder rod away from the thumb and bucket by connecting the end of the cylinder rod to a progressive linkage that is, in turn, connected to the thumb body thus protecting the end of the cylinder rod from potential damage.

Numerous stick and bucket configurations are manufactured and sold by a wide variety of manufacturers. Each thumb linkage must be carefully designed for the specific stick linkage and bucket combination. Once a thumb linkage is designed for a specific stick, linkage, and bucket combination, the thumb linkage will not fit essentially any other stick linkage and bucket configuration. The uniqueness of the linkage design prevents the thumb linkages from being interchanged with other machines and thus increases the cost of owning a thumb with a progressive linkage. Excavator owners usually must purchase and maintain a thumb linkage for each of their machines. Another problem with existing progressive linkages is that they often of limited use when installed on short sticks (those of less than nine feet in length) because there is not sufficient room for the piston cylinder actuator. Although a shorter piston cylinder actuator may be used, the range of motion becomes limited. The industry thus desires a progressive linkage configuration that may be readily fit to a variety of bucket and stick configurations, is easy to install, has a greater range of motion, and lowers owning and operating costs.

Another problem with existing progressive thumb linkages is the installation sequence. The process includes repeated trial and error steps that can consume twelve to sixteen hours. The linkage configuration and the mounting sequence should be simple while improving the range of motion for the thumb. The method of mounting the linkage to the dipper stick and connecting the linkage to the thumb should be easy to understand and minimize the time required to install the tool to the excavator.

SUMMARY OF THE INVENTION

The invention provides a progressive linkage used with a thumb mounted on a dipper stick for a prime mover such as an excavator. The progressive linkage for the thumb is mounted to the stick independent of the tool and tool linkage. More particularly, the idler link of the thumb progressive linkage is mounted to the dipper stick in a location with its pivot axis spaced from the pivot axis of the connection between the tool idler link and the dipper stick.

The invention provides a dipper stick carrying a tool and a thumb. The tool is connected to a tool actuator with a tool linkage having a tool idler link. The tool idler link is connected to the dipper stick at a tool idler link connection that has a pivot axis. The thumb is connected to a thumb actuator with a thumb linkage having a thumb idler link. The thumb idler link is connected to the dipper stick at a thumb idler link connection that has a pivot axis. The improvement of the combination includes the pivot axis of the thumb idler link connection being spaced from the pivot axis of the tool idler link connection.

In one configuration, the invention provides that the pivot axis of the thumb idler link connection is spaced outwardly from the inner surface of the dipper stick. The inner surface of the dipper stick is thus located between the pivot axis of the thumb idler link connection and the outer surface of the dipper stick.

In another configuration, the invention provides a progressive linkage that includes an idler link having a first end pivotably anchored to an anchor mount adapted to be secured to the inner surface of the dipper stick.

The invention also provides a configuration of a dipper stick thumb progressive linkage wherein the location of the connection between the thumb idler link and the dipper stick is independent of the connection between the tool and stick.

In another configuration, the invention provides a thumb progressive linkage having the connection between the thumb actuator and the thumb idler link disposed between the idler anchor location and the idler/power link connection. The idler/power link connection includes spaced apart arms that may be disposed on either side of the thumb actuator when the thumb is in the tuck position.

Another configuration of the invention provides a thumb progressive linkage wherein each of the power link and the idler link includes pairs of spaced link arms. Each of the individual arms of the power link is connected to only one of the individual arms of the idler link with short pins. This configuration allows a portion of the actuator to be disposed between the arms of the idler links when the thumb is in the tuck position thus increasing the range of motion for the thumb.

The invention also provides a method for mounting a progressive linkage for a thumb on a dipper stick.

The different aspects of these invention configurations may be used alone or in combination to define different inventive combinations.

BRIEF DESCRIPTION OF THE DRAWINGS

Similar numbers refer to similar parts throughout the specification.

DETAILED DESCRIPTION OF THE INVENTION

Figure 1:
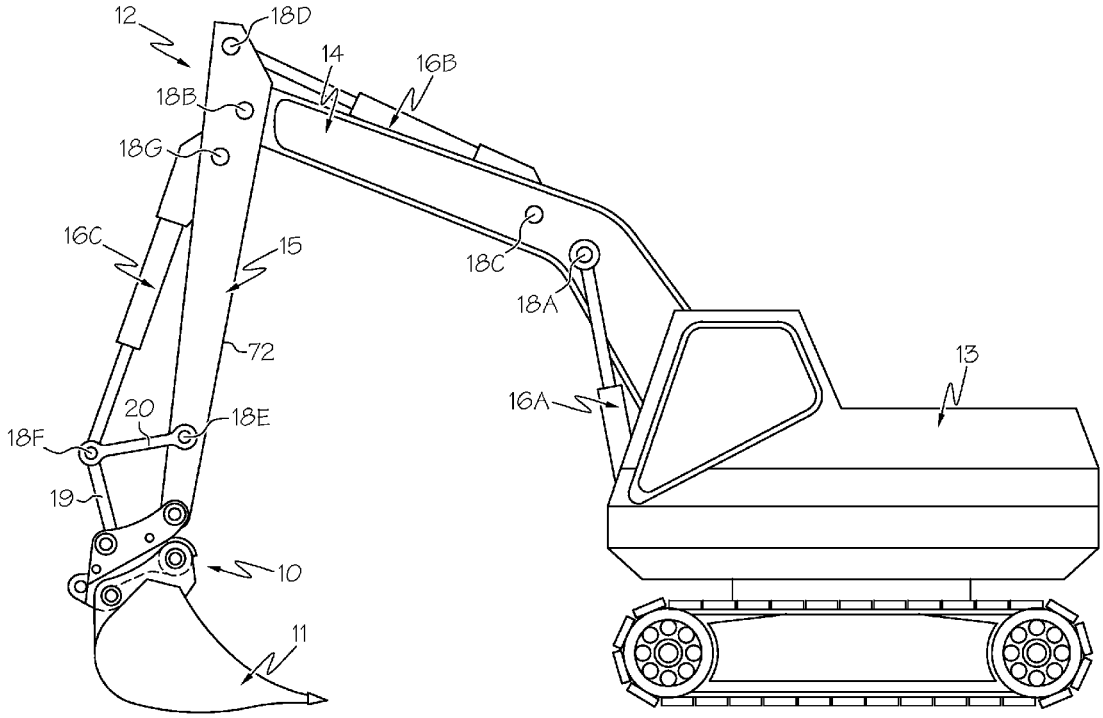
FIG. 1 (PRIOR ART)
FIG. 1 is a side view of a prior art prime mover with a prior art dipper stick and a prior art bucket connected with a prior art coupler.
Figure 2:
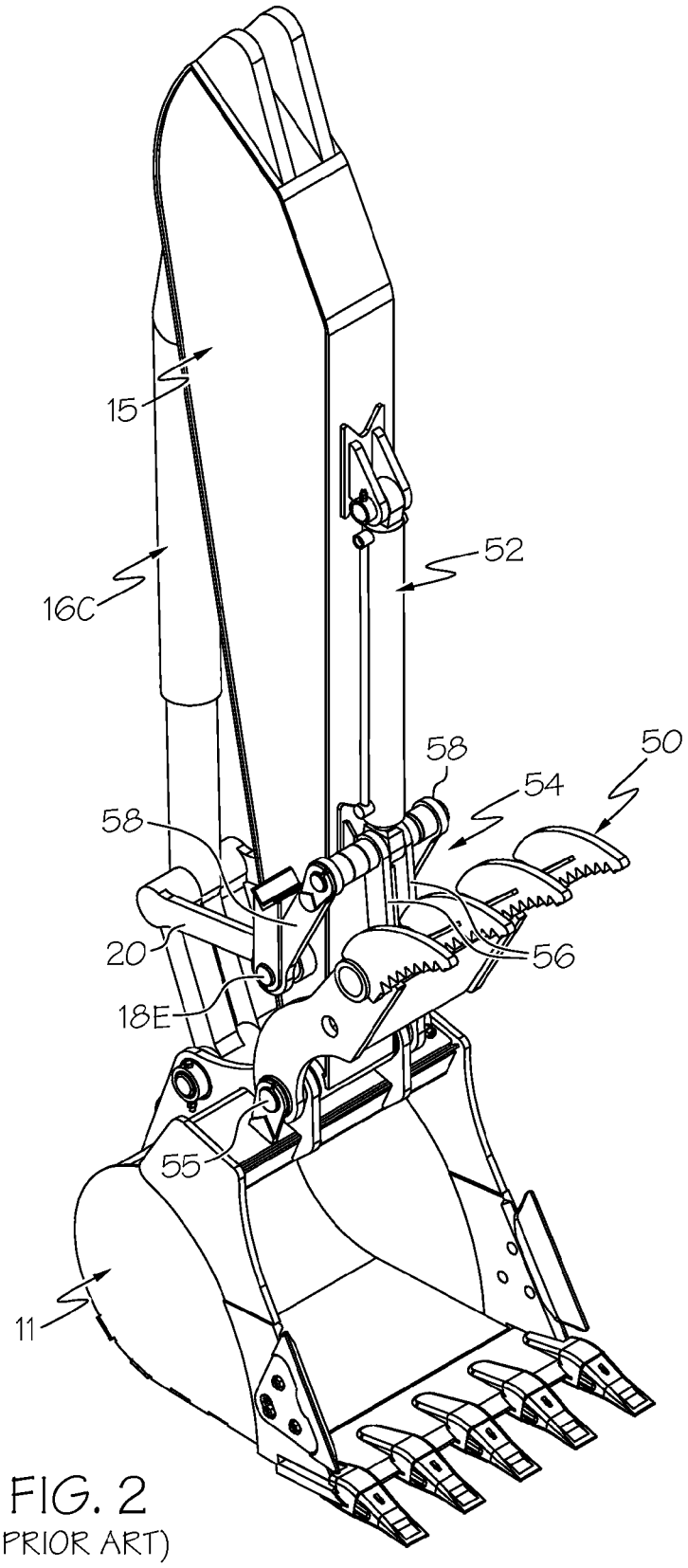
FIG. 2 (PRIOR ART)
FIG. 2 is a front perspective view of a prior art thumb connected to a dipper stick with a prior art progressive linkage.
Figure 3:
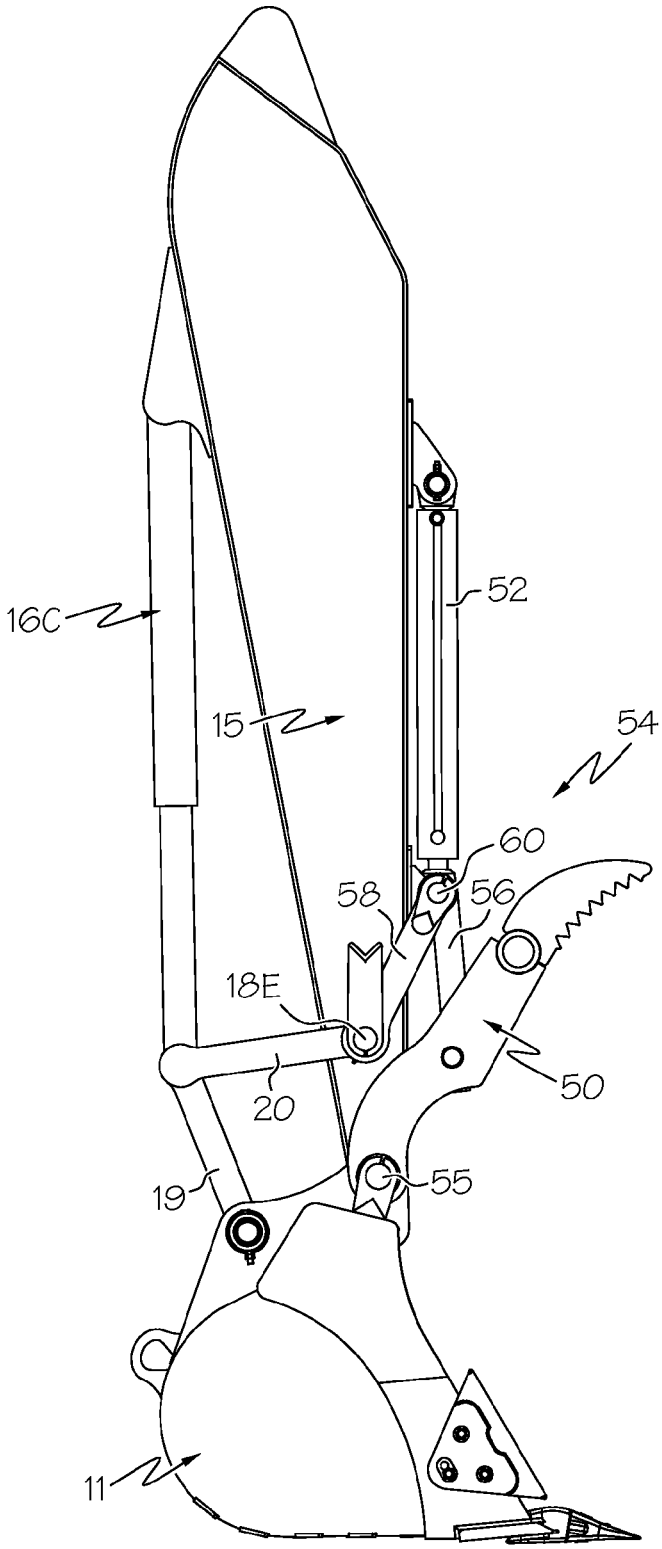
FIG. 3 (PRIOR ART)
FIG. 3 is a side elevation view of FIG. 2 showing the thumb open.
Figure 4:
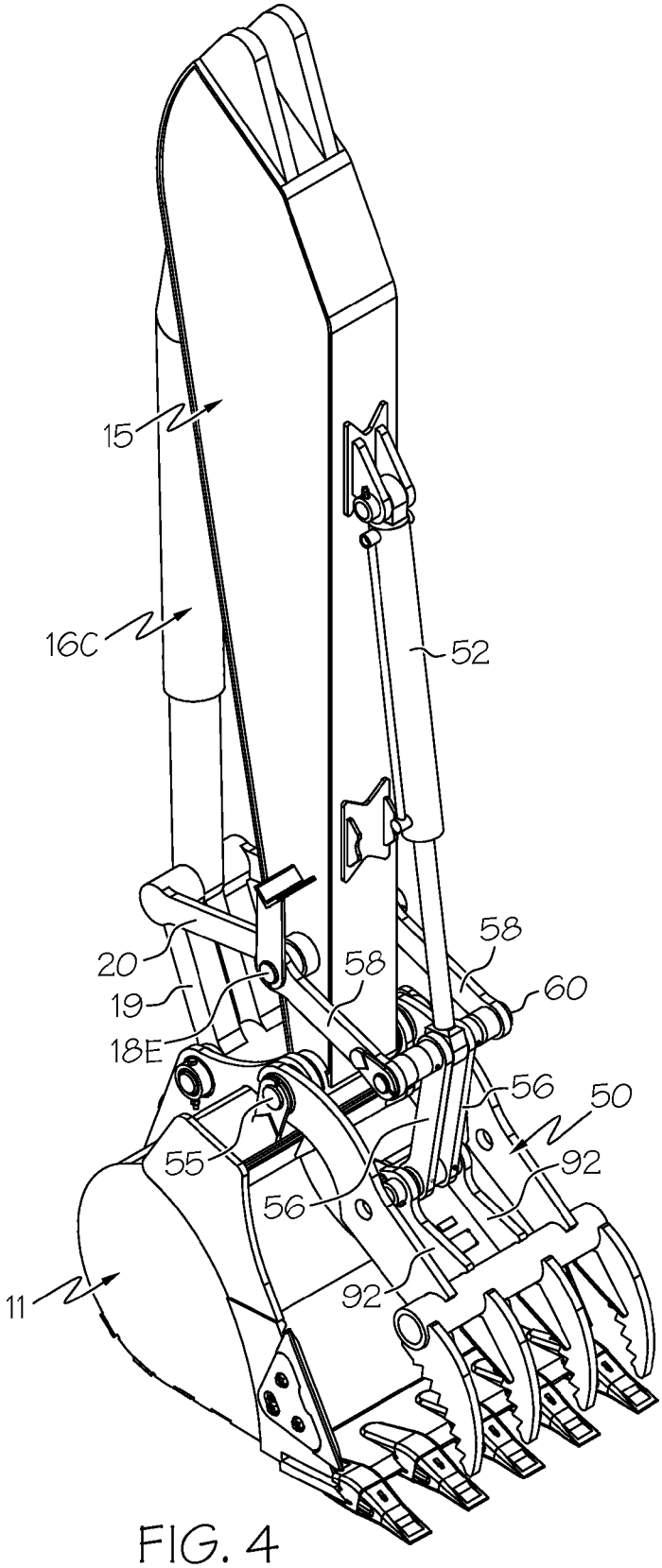
FIG. 4 (PRIOR ART)
FIG. 4 is a view similar to FIG. 2 but showing the thumb closed.
Figure 5:
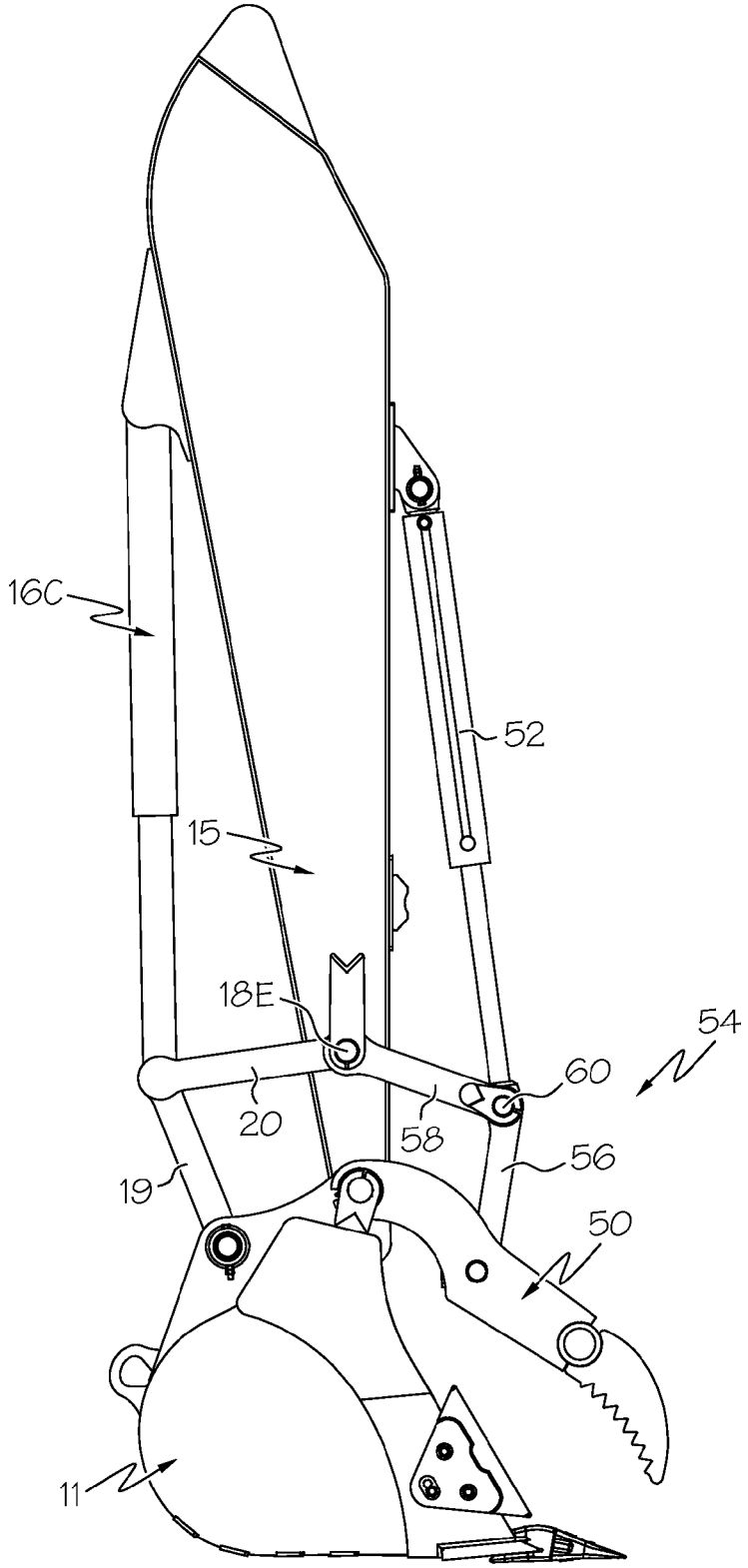
FIG. 5 (PRIOR ART)
FIG. 5 is a side elevation view of FIG. 4.

The progressive linkage of the invention is indicated generally by the numeral 2 in FIGS. 6-12. Linkage 2 operatively connects a thumb actuator 4 to a thumb 6 to allow actuator 4 to control the movement of thumb 6. Linkage 2 allows actuator 4 to move thumb 6 between tuck (FIG. 6) and reach (FIG. 8) positions.

In the exemplary configuration of the invention shown in FIGS. 6-12, thumb 6 is used in combination with a tool in the nature of a bucket 11 mounted the end of a dipper stick 15. The tool in the configurations of this specification also may be a rake. Dipper stick 15 may be any of a variety of known devices and may be used with any of a variety of known prime movers 13. Prime mover 13 may be an excavator such as the prior art device depicted in FIG. 1.

For the purpose of providing an exemplary environment in which linkage 2 may be used, FIG. 1 depicts an exemplary prime mover 13 having an articulating boom 12. In FIG. 1, an optional fast-make coupler 10 is used to connect bucket 11 to stick 15. Coupler 10 is optional but may be used in combination with linkage 2. Bucket 11 may be directly connected to stick 15 as shown in the other drawings. Articulating boom 12 may include proximal and distal boom arms 14 and 15, respectively. The distal boom 15 is also referred to as a dipper stick 15. The inboard end (not shown) of the proximal boom arm 14 is pivotally supported from prime mover 13 in a manner well known to the art. Proximal boom arm 14 may be raised and lowered about the inboard end thereof by an actuator (such as a piston cylinder actuator) 16A that is pivotally connected between prime mover 13 and a pivot pin 18A that may extend transversely through proximal boom arm 14. The inboard end portion of dipper stick 15 is mounted to the outboard end of proximal boom arm 14 for articulation about a pivot pin 18B. Articulation of dipper stick 15 may be selectively controlled by piston cylinder actuator 16B. Specifically, one end of piston cylinder actuator 16B is pivotally supported from the proximal boom arm 14, as by pivot pin 18C, and the other end of piston cylinder actuator 16B is secured to a pivot pin 18D that extends transversely through the lever arm portion of dipper stick 15 at the inboard end thereof.

As previewed in the previous paragraph, and as will be continued in the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are at least two actuators 16 associated with the articulating boom 12. The actuators are generally identified by the numeral 16, but the specific, individual, actuators are, therefore, identified as 16A, 16B, etc. in the specification and on the drawings. On some occasions a numerical subscript shall be employed after the letter suffix when it is necessary, or desirable, to distinguish (as to location) two items that might otherwise properly be designated by the alphanumeric combination of a common number with the same letter suffice. These suffix conventions shall be employed throughout the specification.

Returning to FIG. 1, it will also be observed that an articulating arm 19 is operatively associated with dipper stick 15 to effect pivotal movement of the coupler assembly 10 (this also may be used to pivot bucket 11) about the outboard end of dipper stick 15. Specifically, the inboard end of a tool idler link 20 is pivotally supported on a pivot pin 18E that extends through dipper stick 15, and the outboard end of the idler link 20 is pivotally connected not only to the actuator 16C but also to the inboard end of articulating arm 19, as by pivot pin 18F. The other end of piston cylinder actuator 16C is anchored to the inboard end portion of dipper stick 15, as by pivot pin 18G. As such, the piston cylinder actuator 16C, in combination with the tie rod 20, effects selective, pivotal movement of the coupler assembly 10 by relative movement of the articulating arm 19 with respect to dipper stick 15.

FIGS. 2-5 depict a prior art thumb 50 connected to an actuator 52 with a prior art progressive linkage 54. In these drawings, thumb 50 and tool 11 are connected directly to the end of dipper stick 15 with a common pin 55. Other mounting configurations also are known in the art. These include mounting thumb 50 directly to tool 11 with a pin and mounting thumb 50 directly to dipper stick 15 with its own pin at a location spaced from the pin that mounts tool 11. Thumb 50 also may be used with coupler 10. Progressive linkage 2 described below may be used with any of these mounting configurations.

Linkage 54 includes a power link 56 connected to thumb 50 and an idler link 58 anchored to dipper stick 15. Idler link 58 is anchored to stick 15 with the same pin 18E that anchors idler link 20 of tool 11. A common long pin 60 is used to connect the ends of links 56 and 58 with the separate arms of power link 56 disposed between the ends of idler link 58. Pin 60 is also used to receive the end of actuator 52 between the ends of the arms of power link 56.

Figure 9:
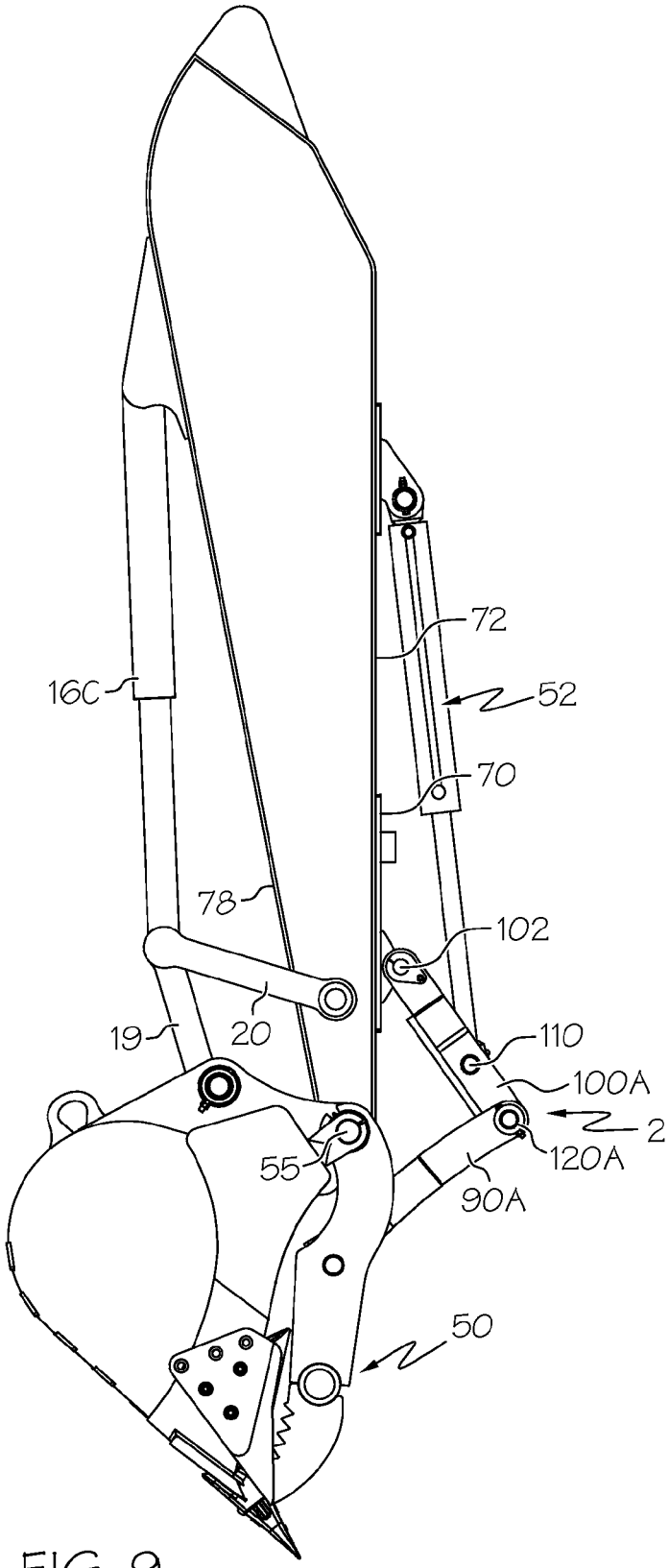
FIG. 9 is a side elevation view of FIG. 8.
Figure 10:
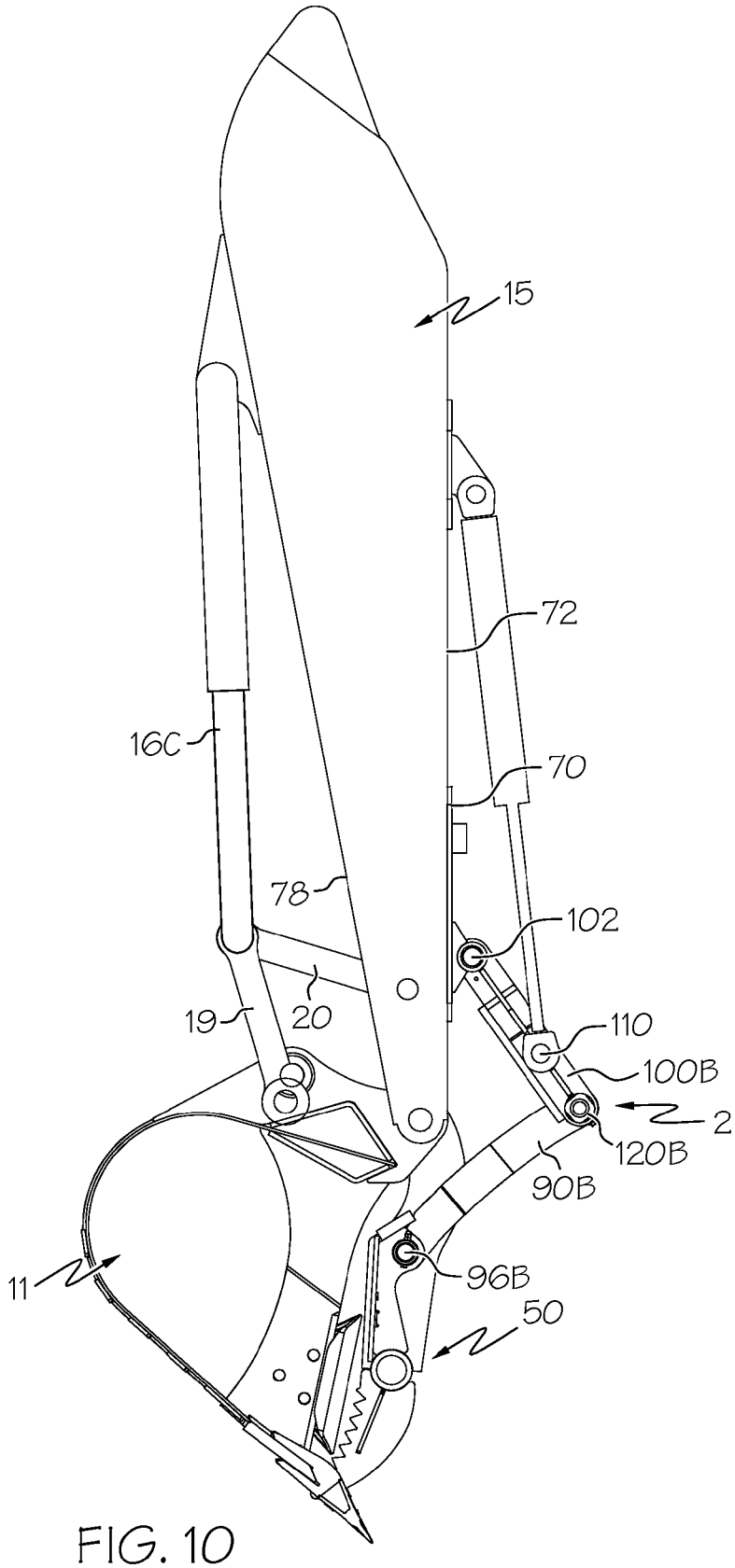
FIG. 10 is a section view showing half of the progressive linkage.
Figure 11:
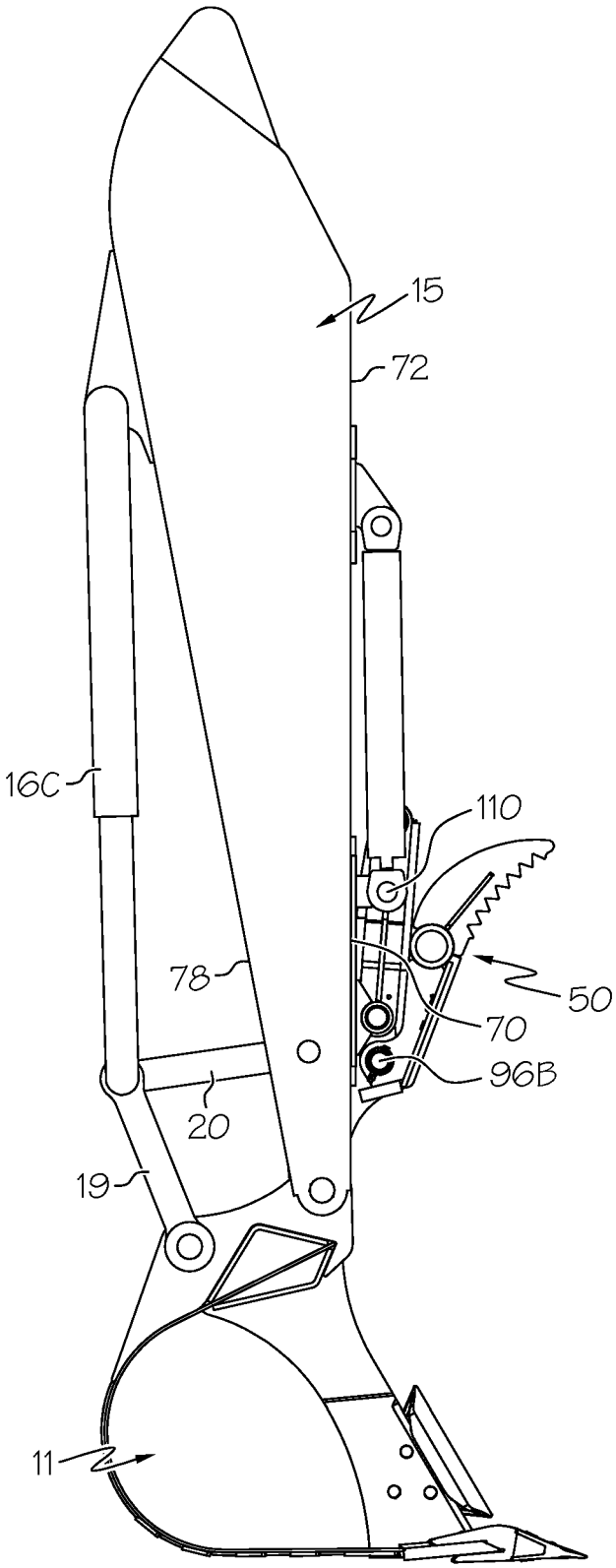
FIG. 11 is a section view taken through the thumb and progressive linkage showing a direct connect weld on thumb (not pinned to the same pin as the bucket.
Figure 12:
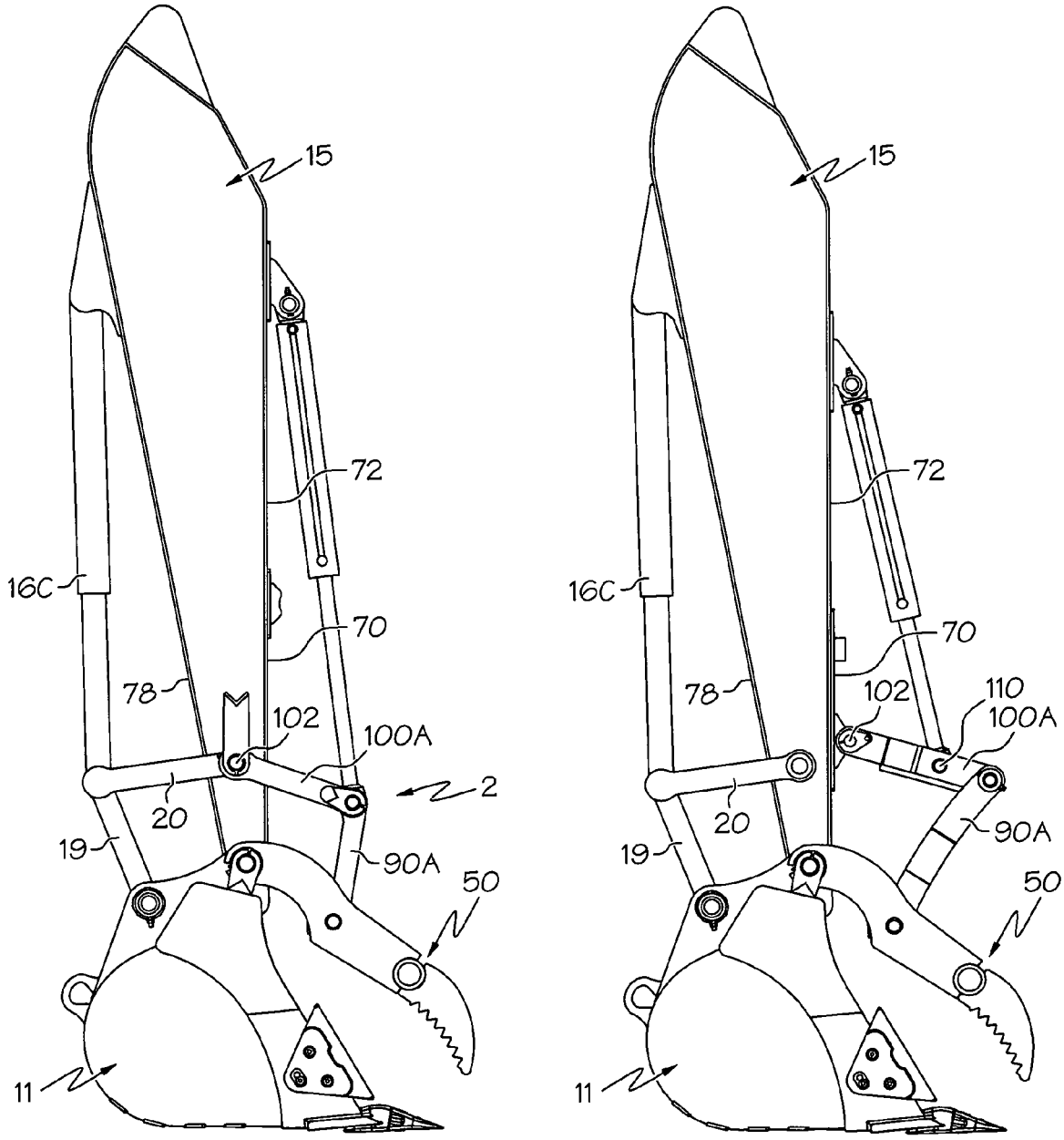
PRIOR ART FIG. 12
FIG. 12 is a side-by-side comparison of the prior art progressive thumb linkage of FIG. 5 compared to the progressive thumb linkage of the invention.

FIGS. 6-12 depict progressive linkage 2 used with bucket 11 and thumb 50. In FIGS. 6-10 and 12, bucket 11 and thumb 50 are pinned to the end of dipper stick 15 with common pin 55. In FIG. 11, thumb 50 is mounted to stick 15 at a different location than bucket 11. In the FIG. 11 configuration, different pins are used to mount bucket 11 and thumb 50. As noted above, progressive linkage 2 provides the connection between actuator 52 and thumb 50.

Figure 7:
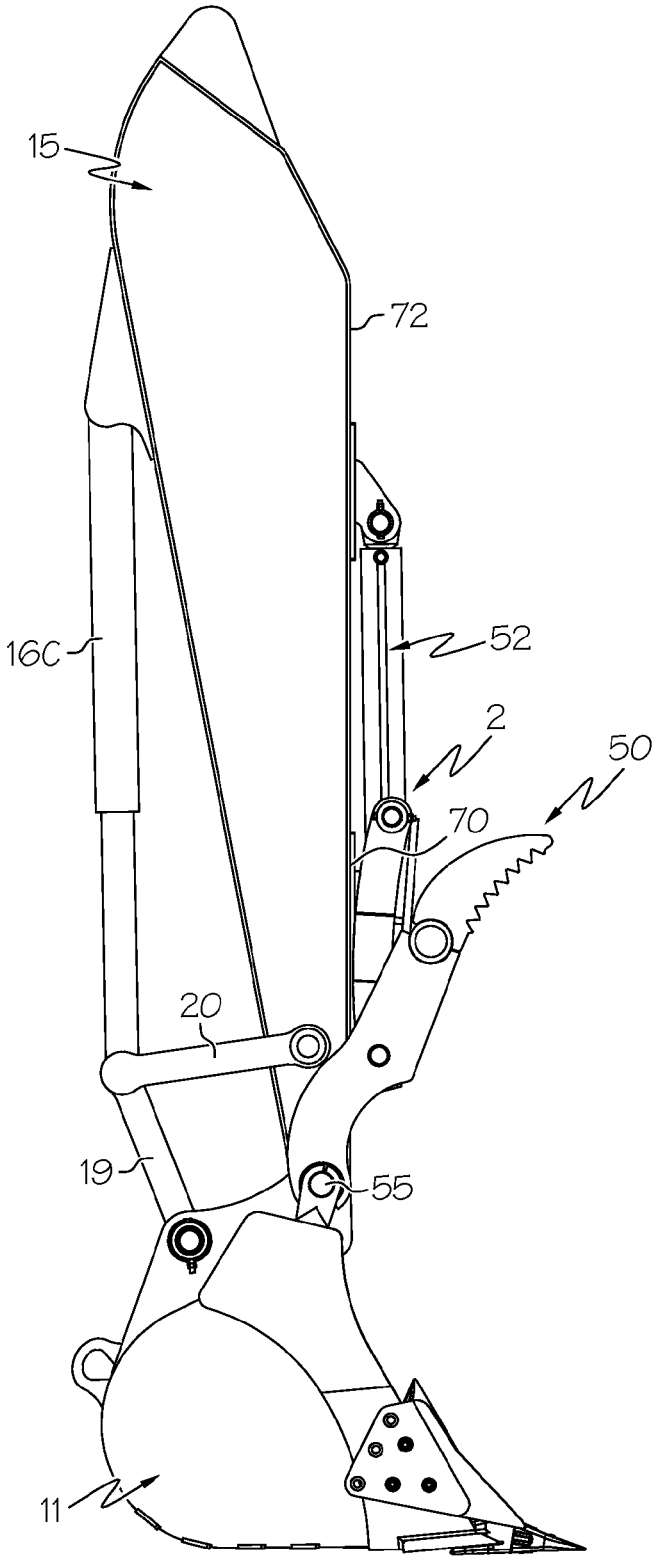
FIG. 7 is a side elevation view of FIG. 6.

Linkage 2 is anchored to dipper stick 15 at a location different than idler link 20. Using a different connection point for linkage 2 allows linkage 2 to be designed for a wide variety of stick 15, bucket 11, and thumb 50 combinations. Instead of using the existing mounting pin and mounting location for the tool idler link, the invention provides an anchor mount for idler link 100. The anchor mount may be secured directly to a surface of dipper stick 15 to provide pivotable support to idler link 100. In the configuration of the invention depicted in the drawings, linkage 2 includes an anchor plate 70 that is used to secure linkage 2 to stick 15. Plate 70 may be welded to the inner surface 72 of stick 15 to provide the structure for linkage 2 to pivot against. Anchor plate 70 is disposed outwardly (away from the middle) of inner surface 72. The ends 74 of anchor plate 70 are non-parallel to the sides 76 of dipper stick 15 (ends 74 may be V-shaped) to prevent the welds from undesirably weakening dipper stick 15. In the context of this specification, inner surface 72 of stick 15 is the face of stick 15 with thumb actuator 52 with the outer surface 78 being disposed on the opposite side where tool actuator 16C is located. When viewed from the side as shown in FIGS. 7, 9, and 10, this configuration locates inner surface 72 of stick 15 between the pivot connection of linkage 2 and the outer surface 78 of dipper stick 15. The anchor mount may be in the form of a plate such as plate 70 or other structures that provide pivotable support to a link such as flanges or bosses projecting from stick 15.

Figure 8:
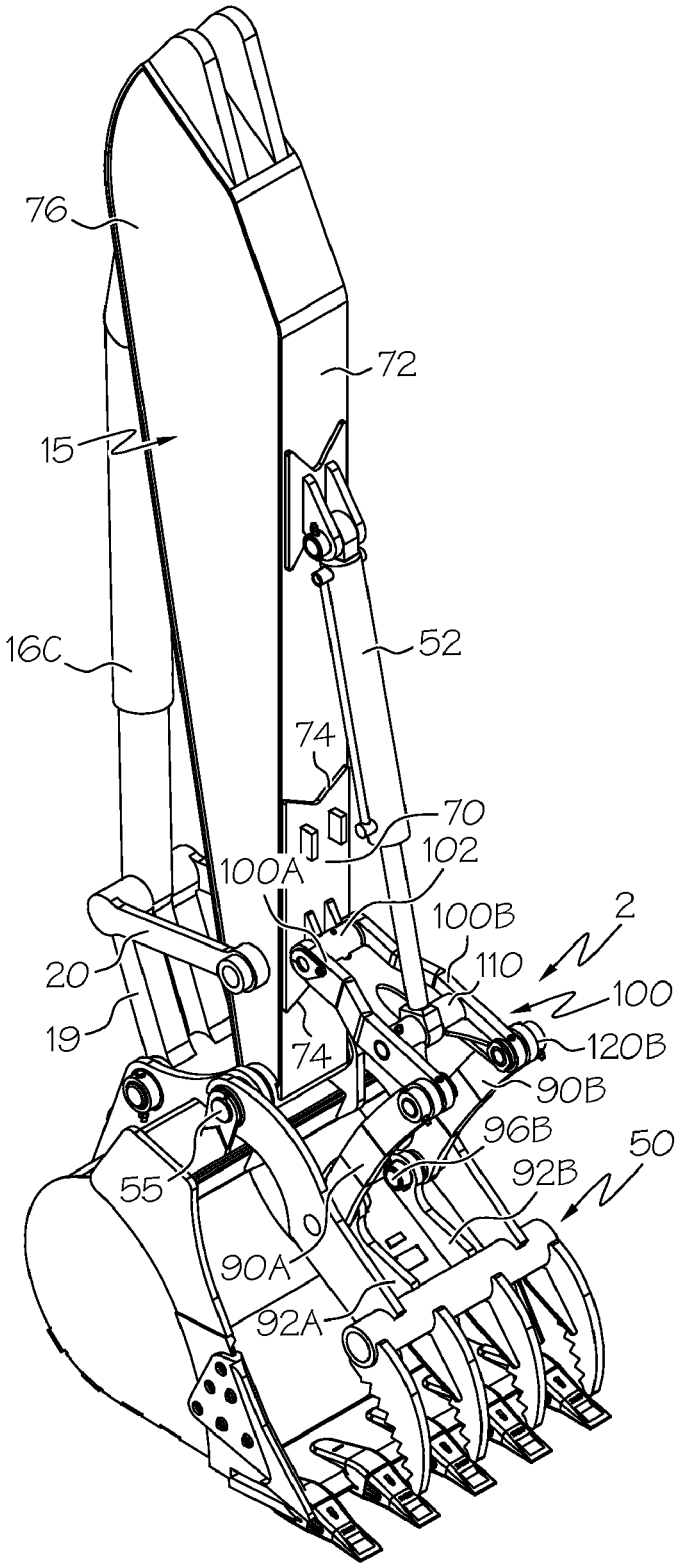
FIG. 8 is similar to FIG. 6 but showing the thumb closed.

As shown in FIGS. 8-10, linkage 2 includes a power link 90 connected to the yoke 92 of thumb 50. In the exemplary configuration of linkage 2, power link 90 includes a pair of arms 90A and 90B. The first end of each power link arm 90A and 90B is pivotably connected to yoke 92 with a pin 96A and 96B. Each pin 96 only needs to be long enough to pass through arm 90 and yoke 92. Pins 96A and 96B are thus considered short pins and are thus less prone to bending than the long pin used in the prior art configuration of FIG. 4 wherein a single pin connected both arms of power link 56 to yoke 92. In another configuration of linkage 2, power link 90 may be in the form of a single arm connected to yoke 92. Power link 90 thus includes at least one arm.

Linkage 2 also includes an idler link 100 having a first end pivotably anchored to dipper stick 15 via anchor plate 70. In the exemplary configuration of linkage 2, idler link 100 includes a pair of arms 100A and 100B. A common pin 102 is used to pivotably connect the first ends of idler arms 100A and 100B to a mounting structure that projects from plate 70. Idler link 100 may be provided in the form of a single arm instead of the spaced arms shown in the drawings. Pin 102 is offset outwardly from inner surface 72. Pin 102 is also spaced from pin 18E such that linkage 2 is mounted independent of idler 20. Idler link 100 thus does not have to be specifically designed to align with link 20. Further, because the position of anchor plate 70 with respect to dipper stick 15 is not critical, it may be adjusted before welding to fit the particular combination of devices used with dipper stick 15. This mounting configuration thus allows linkage 2 to be manufactured in a standard configuration that fits a variety of stick, tool, and thumb combinations. The mounting configuration also decreases the installation time because pin 18E does not have to be removed and reassembled and because locating the correct position of anchor plate 70 with respect to stick 15 is easy and independent of the location of pin 18E.

Actuator 52 is connected to idler link 100 at a location intermediate the first and second ends of idler link 100. An actuator mounting pin 110 is disposed between arms 100A and 10B. Pin 110 pivotably receives actuator 52. Locating pin 110 closer to pin 102 allows actuator 52 to be shortened and helps to protect the end of actuator 52 from damage while thumb 50 is in use. The drawings also show how the first ends of link arms 100 are disposed closer together than the width of dipper stick 15 at the location of the connection. Each link arm 100 may define an "S" bend so that the second ends of link arms 100 are spaced apart wider than the first ends. Reinforcing plates may be placed between arms 100 as shown in FIG. 8.

Figure 6:
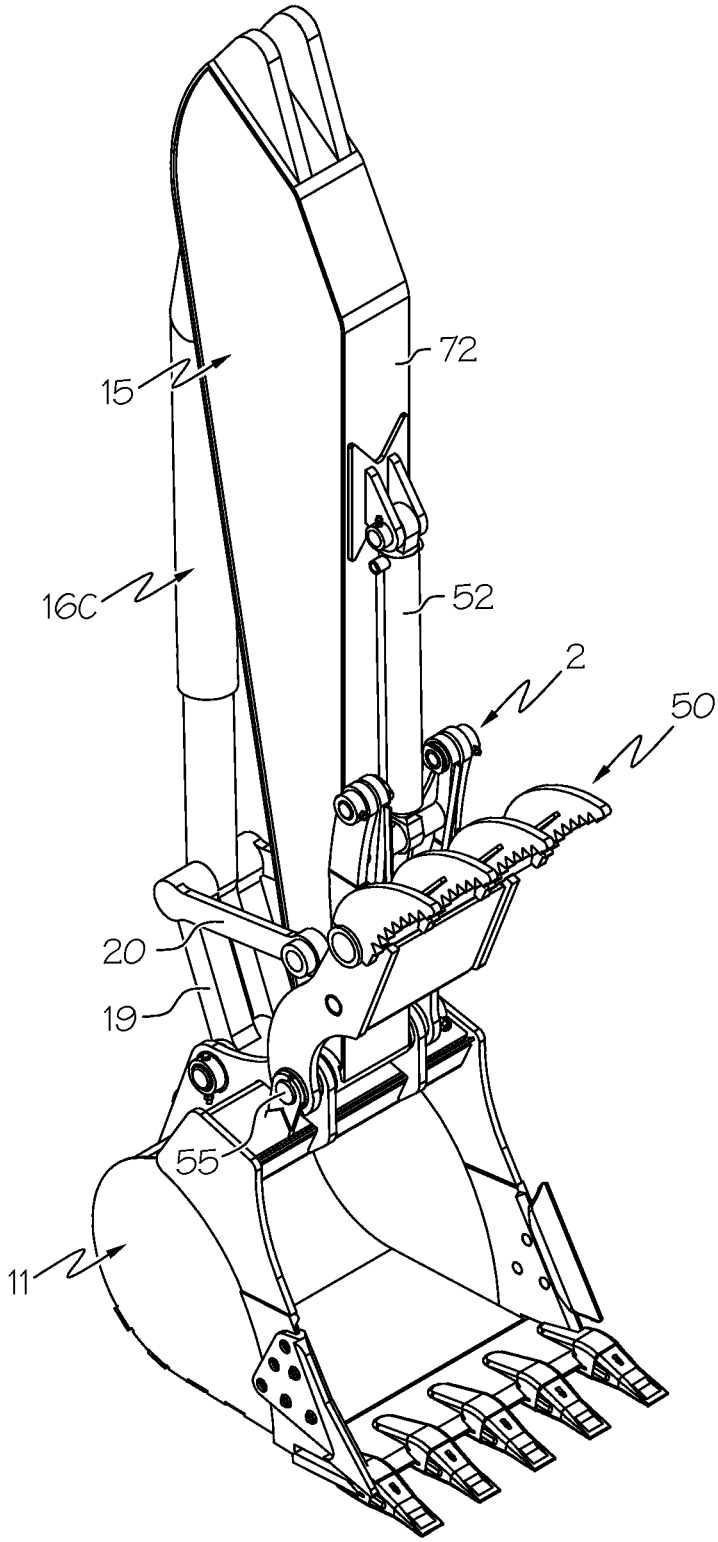
FIG. 6 is a front perspective view of a pin on thumb connected to a dipper stick in one of the exemplary configurations of the invention.

A pair of short pins 120A and 120B connect the second ends of idler link arms 100A and 100B to the second ends of power link arms 90A and 90B. Link arms 100 are disposed between the second ends of power link arms 90 and provide space to receive the end of actuator 52 as shown in FIG. 7 when actuator 52 is retracted to completely open thumb 50. This configuration provides a larger range of motion for thumb 50 as compared to the prior art linkage because the connections between arms 90 and 100 may be moved to a position where they are on either side of actuator 52 as shown in FIGS. 6, 7 and 11.

The mounting configuration allows the linkage to be mounted to the dipper stick in a manner that saves considerable time over prior art linkages and mounting methods. As described above, the person mounting the linkage does not have to remove any portion of the tool linkage in order to mount the thumb linkage thus saving the time of disassembling and reassembling the tool linkage. In addition, the problem of locating the actuator on the dipper stick is solved because the actuator position is not directly related to the pivot axis between the tool idler link and the dipper stick. The actuator may be connected to the thumb linkage and the thumb is moved to its tuck position. Plate 70 and the actuator bracket are located on stick 15 with actuator 52 almost fully retracted. The thumb is then moved to its reach position and the locations are checked with respect to the extension of actuator 52. If acceptable, the mounting locations are double checked and plate 70 and the actuator bracket are welded to dipper stick 15.

In the context of this application, the term "include" has the same meaning as the term "comprise" with both terms being inclusive of the specific element mentioned without excluding other elements. In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described.

The invention claimed is:

1. A dipper stick carrying a tool and a thumb; the dipper stick having an inner surface; the tool being connected to a tool actuator with a tool linkage having a tool idler link; the tool idler link being connected to the dipper stick at a tool idler link connection; the tool idler link connection having a pivot axis; the thumb being connected to a thumb actuator with a thumb linkage having a thumb idler link; the thumb idler link being connected to the dipper stick at a thumb idler link connection; the thumb idler link connection having a pivot axis; the thumb actuator being disposed on the inner surface side of the dipper stick; the improvement comprising:

the pivot axis of the thumb idler link connection being spaced from the pivot axis of the tool idler link connection; and the pivot axis of the thumb idler link connection being offset outwardly from the inner surface of the dipper stick.

2. The improvement of claim 1, wherein the inner surface of the dipper stick is disposed between the thumb idler link connection and the tool idler link connection.

3. The improvement of claim 1, wherein the improvement further comprises an anchor plate adapted to be secured to the inner surface of the dipper stick; the thumb idler link being pivotably connected to the anchor plate.

4. The improvement of claim 1, wherein the thumb linkage further includes a thumb power link connected to the thumb idler link; the improvement further comprising the power link having a pair of thumb power link arms disposed outwardly of the thumb idler link.

5. The improvement of claim 4, wherein the improvement further comprises the thumb idler link including an actuator mounting pin disposed intermediate the thumb idler link connection and the connection between the thumb idler link and the thumb power link; and the thumb actuator adapted to be connected to the actuator mounting pin.

6. The improvement of claim 5, wherein the thumb idler link includes two idler link arms; each of the idler link arms having a first end and a second end; the actuator mounting pin is disposed between two idler link arms intermediate the first and second ends of the arms.

7. The improvement of claim 6, wherein the dipper stick has a width at the thumb idler link connection; the first ends of the idler link arms being spaced apart a distance that is less than the width of the dipper stick at the location where the linkage is connected to the dipper stick.

8. The improvement of claim 7, wherein the improvement further comprises an anchor plate adapted to be secured to the dipper stick; the first ends of the idler arms being pivotably connected to the anchor plate.

9. The improvement of claim 8, wherein the dipper stick has sidewalls; the anchor plate having first and second ends; each of the first and second ends having a configuration that does not extend straight across the dipper stick.

10. The improvement of claim 9, wherein the first and second ends of the plate have a V-shaped configuration.

11. A dipper stick, tool, and thumb combination for use with a prime mover; the combination comprising:

a dipper stick having an inner surface, and outer surface, and a pair of side surfaces;

the dipper stick having a first end;

a first tool mounted to the dipper stick adjacent the first end; the tool being connected to a tool actuator with a tool linkage having a tool idler link; the tool idler link being connected to the dipper stick at a tool idler link connection; the tool idler link connection having a pivot axis disposed through the body of the dipper stick;

a thumb mounted to the dipper stick adjacent the first end; the thumb movably mounted with respect to the dipper stick so that the thumb may cooperate with the first tool;

a thumb actuator;

a progressive linkage operatively connecting the thumb to the thumb actuator; the progressive linkage having a power link pivotably connected to an idler link; the power link being connected to the thumb; the idler link pivotably connected to the dipper stick to define a first pivot axis; and the first pivot axis is offset outwardly from inner surface of the dipper stick with the inner surface of the dipper stick being disposed between the first pivot axis and the outer surface of the dipper stick.

12. The combination of claim 11, further comprising an anchor plate adapted to be secured to the inner surface of the dipper stick; the thumb idler link being pivotably connected to the anchor plate.

13. The combination of claim 11, wherein the power link has a pair of power link arms disposed outwardly of the thumb idler link.

14. The combination of claim 11, wherein the thumb idler link includes an actuator mounting pin disposed intermediate the first pivot axis and the connection between the thumb idler link and the thumb power link; and the thumb actuator being connected to the actuator mounting pin.

15. The combination of claim 14, wherein the thumb idler link includes two idler link arms; each of the idler link arms having a first end and a second end; the actuator mounting pin being disposed between two idler link arms intermediate the first and second ends of the arms.

16. The combination of claim 15, wherein the dipper stick has a width adjacent the first pivot axis; the first ends of the idler link arms being spaced apart a distance that is less than the width of the dipper stick adjacent the first pivot axis.

* * * * *